US007419078B2

(12) United States Patent
Hamar

(10) Patent No.: US 7,419,078 B2
(45) Date of Patent: Sep. 2, 2008

(54) NAILING DEVICE

(76) Inventor: Douglas J. Hamar, 300 Cooper, Hancock, MI (US) 49930

( * ) Notice: Subject to any disclaimer, the term of this patent is extended or adjusted under 35 U.S.C. 154(b) by 0 days.

(21) Appl. No.: 11/489,769

(22) Filed: Jul. 20, 2006

(65) Prior Publication Data

US 2007/0017953 A1 Jan. 25, 2007

Related U.S. Application Data

(60) Provisional application No. 60/701,095, filed on Jul. 20, 2005.

(51) Int. Cl.
*B27F 7/02* (2006.01)

(52) U.S. Cl. ..... 227/111; 227/7; 227/110; 227/140; 227/148

(58) Field of Classification Search ..... 227/7, 227/110, 111, 148, 2, 140, 129, 119, 156; 29/709, 714, 798
See application file for complete search history.

(56) References Cited

U.S. PATENT DOCUMENTS 3,619,895 A * 11/1971 Thompson ..... 29/432
3,764,053 A * 10/1973 Thompson ..... 227/111
3,796,365 A * 3/1974 Downing ..... 227/8
3,820,704 A * 6/1974 Stanley ..... 227/110
3,984,040 A * 10/1976 Fry ..... 227/7
4,225,074 A * 9/1980 Jacobson ..... 227/2
4,732,307 A * 3/1988 Hubbard et al. ..... 227/7
5,125,552 A * 6/1992 Medwed ..... 227/156
5,197,257 A * 3/1993 Nietling ..... 52/749.12
5,381,597 A * 1/1995 Petrove ..... 29/714
5,749,508 A * 5/1998 Clothier ..... 227/7
6,269,996 B1 8/2001 McAllister
6,527,156 B2 3/2003 McAllister et al.
6,736,303 B2 * 5/2004 Bruins et al. ..... 227/99
6,755,334 B2 * 6/2004 Ballent, Jr. ..... 227/2

* cited by examiner

*Primary Examiner*—Scott A. Smith
(74) *Attorney, Agent, or Firm*—Richard W. Hoffmann; Reising Ethington Barnes Kisselle PC

(57) ABSTRACT

A nailer device having a carriage assembly, a pair of pivotal drive wheels, a nailer assembly and at least one end wheel. The pair of pivotal drive wheels are on the carriage assembly. The at least one end wheel is disposed adjacent an end of the carriage assembly. A drive motor can be associated with at least one of the pair of pivotal drive wheels when the nailer device is operating in an automatic mode. A handle disposed either intermediate of the pivotal drive wheels can be used to move or manually operate the nailer device and move the nailer device to an adjacent row of floorboards to be secured. A pair of adjustable wheels is also provided to adjust the height of the device.

42 Claims, 10 Drawing Sheets

NAILING DEVICE

CROSS-REFERENCE TO RELATED APPLICATION

The instant application claims priority to U.S. Provisional Patent Application Ser. No. 60/701,095 filed Jul. 20, 2005 the entire specification of which is expressly incorporated herein by reference.

FIELD OF THE INVENTION

The present invention relates to a nailing device for driving fasteners into flooring material.

BACKGROUND OF THE INVENTION

Installing flooring can be a very time consuming and labor intensive process. This is especially true when the flooring being installed is a wood floor which has to be installed using individual boards which typically interlock with one another and are secured to a subfloor. Typically, the panels of wood floors have a groove extending longitudinally along a side of the board and groove extending longitudinally along the opposite side of the board so that the tongue of one board is accepted by the groove of an adjacent board.

Further, when installing a wood floor, it is undesirable to have any marks on the top surface of the floor from the component securing the floor to the subfloor. Thus, nailer devices are used to drive a nail or staple at an angle through the side of the floorboard so that the floorboard can be adequately secured to the subfloor without having any blemishes on the top surface of the floorboard. Again, this is a time consuming process where the nailer device must be placed along the edge of the floorboard so that the securing component can be driven through the floorboard at the desired angle.

There are devices which are used to move along a floorboard being secured to a subfloor which aligns the nailer device to the floorboard. Typically, nailers which are used with these devices and nailers which are used independently of the devices, have a pad which rests on the top of the floorboard being secured to the subfloor so that the nailer is properly aligned with the side of the floorboard. However, as the device moves along the floorboard, in some instances, the pad of the nailer may create friction which may cause the device to pivot and become misaligned with the floorboard being secured to the subfloor.

In addition, floorboards typically come in different heights. When the floorboards are being secured manually, the operator can adjust the nailer device accordingly by aligning the nailer with the floorboard in the desired manner. However, when the nailer device is automated, the nailer may not be properly aligned so that the fastener extends through the side of the board in the desired manner.

Therefore, it is desirable to develop a nailer device which is motorized so that the device moves along the floorboard and aligns the floorboard in order to secure the floorboard to the subfloor. It is also desirable to develop a nailer device that is adjustable in height in which the pad of the nailer does not contact the floorboard so that the nailer device does not become misaligned with the floorboard, and can function properly with floorboards having different heights.

SUMMARY OF THE INVENTION

An embodiment of the present invention relates to a nailer device having a carriage assembly, a pair of pivotal drive wheels, a nailer assembly, at least one end wheel, and a drive motor. The pair of pivotal drive wheels are on the carriage assembly. The at least one end wheel is disposed adjacent an end of the carriage assembly. The drive motor is associated with at least one of the pair of pivotal drive wheels.

Another embodiment of the present invention relates to a nailer device having a carriage assembly, a pair of pivotal drive wheels, a nailer assembly, at least one end wheel, and at least one adjustable wheel. The pair of pivotal drive wheels are on the carriage assembly. The at least one end wheel is disposed adjacent an end of the carriage assembly. The at least one adjustable wheel is connected to the carriage assembly.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
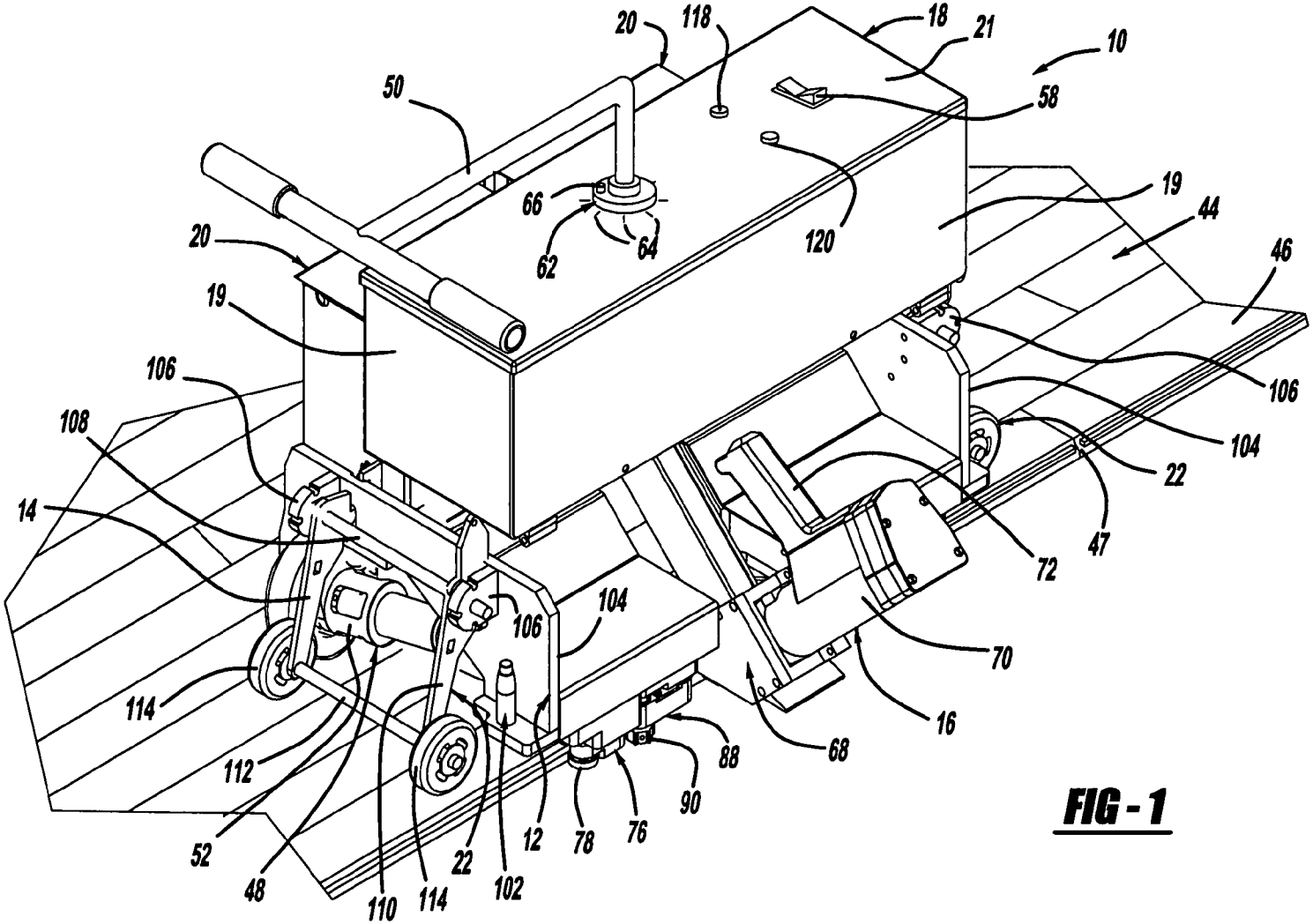
FIG. 1 is perspective view of a nailing device in accordance with the present invention.

A nailing device is generally shown at 10 in FIG. 1. The nailing device is particularly adapted for driving fasteners such as, for example, nails or staples into flooring material, preferably tongue-and-groove hardwood material. The flooring material is preferably tongue-and-groove flooring that is secured to a support structure. The support structure can comprise a subfloor of suitable material or a plurality of sleepers, as are well known in the art. It will be appreciated that the support structure can comprise any suitable structure.

The nailing device 10 includes a carriage assembly generally indicated at 12. The carriage assembly 12 supports drive wheels 14. The carriage assembly 12 also supports a nailer assembly generally indicated at 16. The carriage assembly 12 further supports a programmable logic chip (PLC) housing generally indicated at 18 and a pair of battery housing generally indicated at 20. Further, the carriage assembly 12 supports a pair of end wheel assemblies generally indicated at 22.

Figure 5:
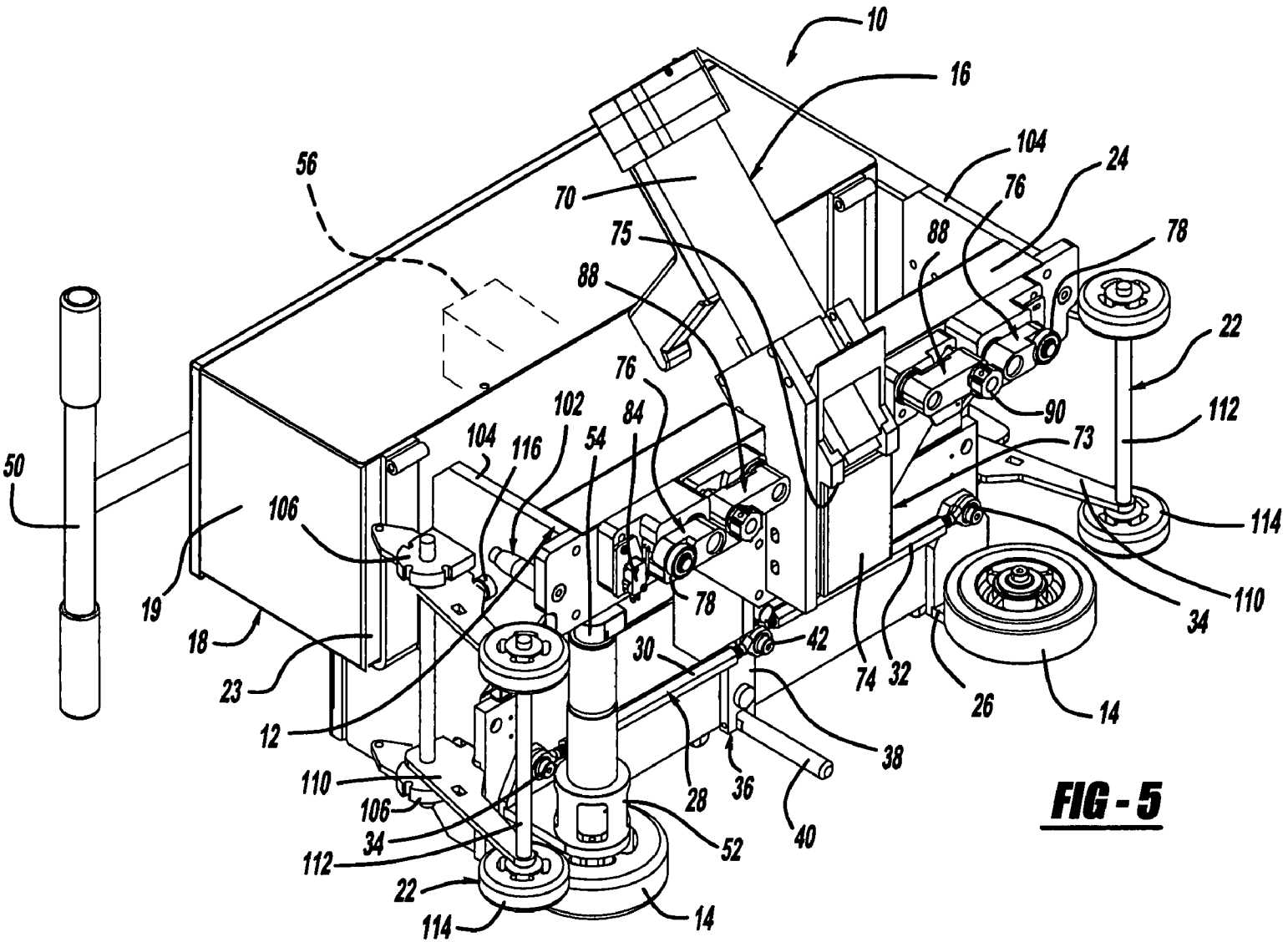
FIG. 5 is a perspective view of the embodiment of FIG. 1.
Figure 6:
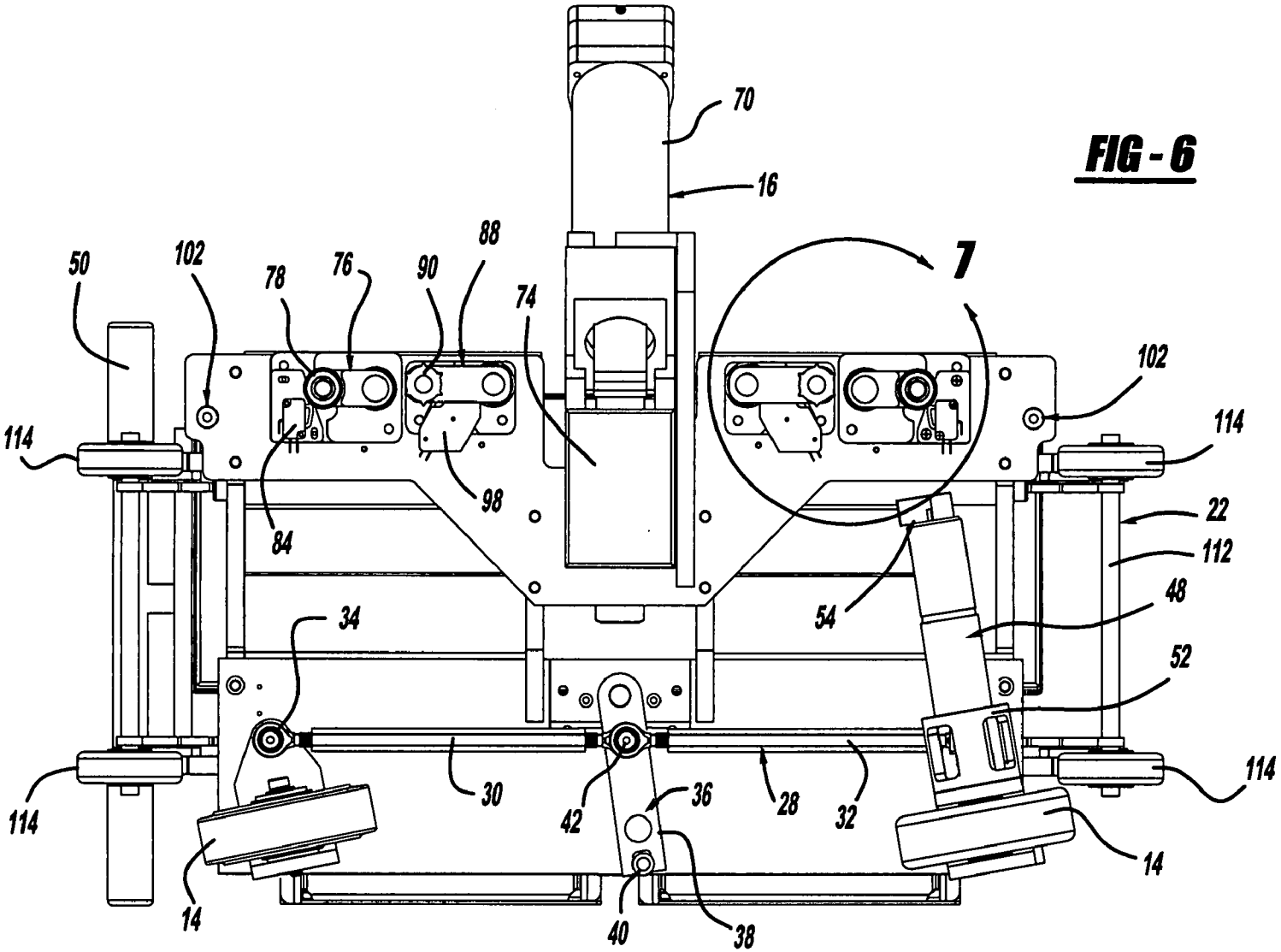
FIG. 6 is a bottom view of the embodiment of FIG. 1.

As best seen in FIGS. 5 and 6, carriage assembly 12 includes a base 24. Base 24 includes a pair of axle brackets 26 pivotally mounted thereon. The axle brackets 26 support a pair of drive wheels 14. The drive wheels 14 are interconnected via a tie rod assembly generally indicated at 28. The tie rod assembly 28 includes a first tie rod 30 and a second tie rod 32. The first tie rod 30 is connected to one of the drive wheels 14. The second tie rod 32 is connected to the other of the drive wheels 14. More specifically, the axle brackets 26 that support drive wheels 14 each include a pin 34 for pivotally receiving one end of the first tie rod 30 and second tie rod 32, respectively. The first tie rod 30 and second tie rod 32 are pivotally secured to pins 34.

The first tie rod 30 and second tie rod 32 are joined at a lever assembly generally indicated at 36. The lever assembly 36 includes a lever plate 38 pivotally secured to the base 24. The lever plate 38 includes a lever handle 40 depending therefrom. The lever assembly 36 further includes a mounting pin 42 for receiving one end of each of the first tie rod 30 and second tie rod 32. The first and second tie rods 30, 32 are pivotally mounted to the mounting pin 42. Movement of the lever handle 40 imparts a pivoting motion to the lever plate 38 and thereby moves the first tie rod 30 and second tie rod 32. This movement causes the drive wheels 14 to be pivoted relative the base 24. Movement of the lever handle 40 in the opposite direction causes the drive wheels 14 to pivot in the opposite direction. Thus, the drive wheels 14 can be pivoted in two directions. Such movement of the drive wheels is best viewed in FIG. 6.

Figure 4:
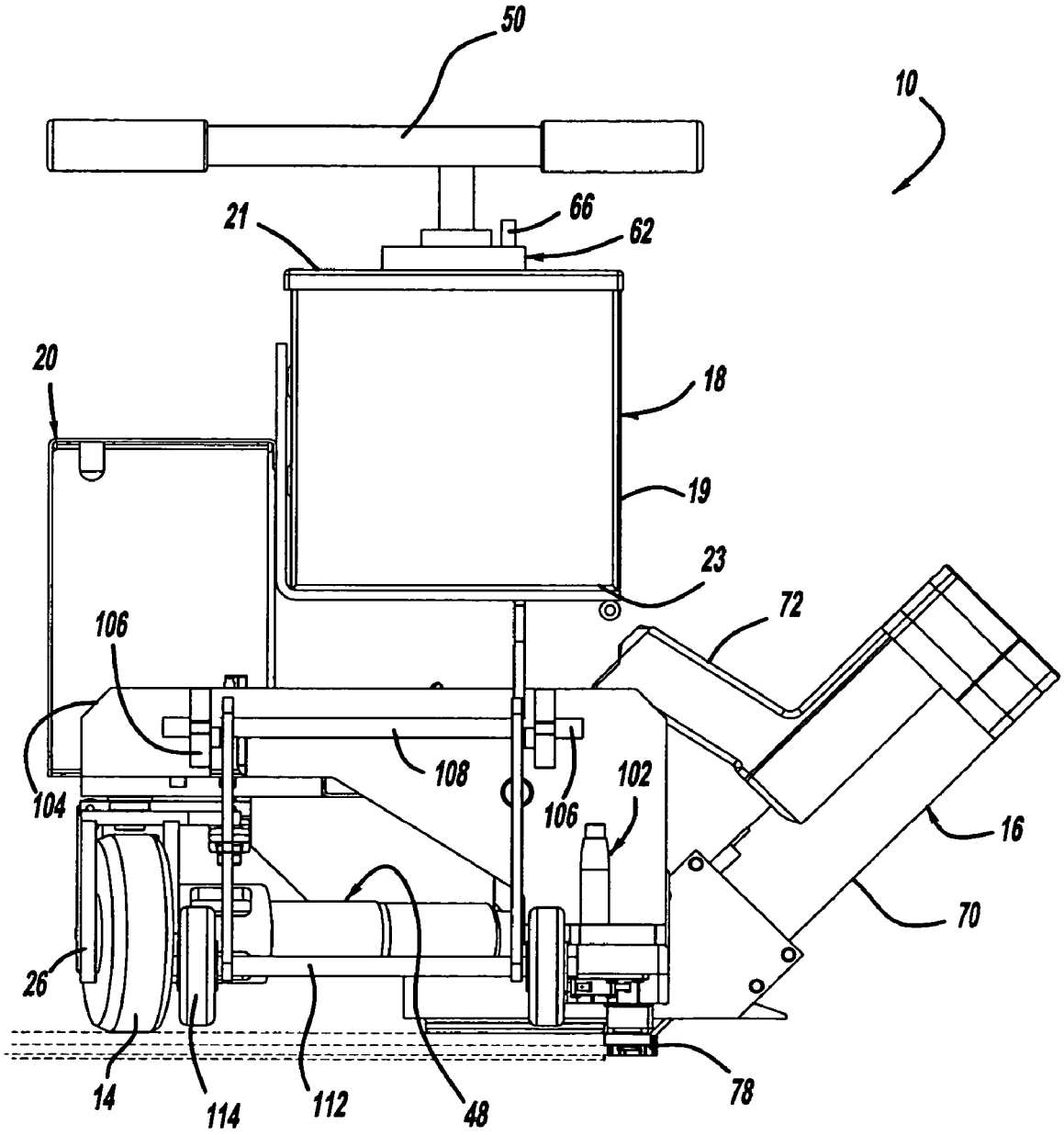
FIG. 4 is a end view of the embodiment of FIG. 1.

A primary purpose of the pivoting of the drive wheels 14 is so that the drive wheels 14 are canted or angled with respect to the floorboards, generally indicated at 44 when the nailing device 10 is in operation. In this manner, the nailing device 10 is drawn into the end floorboard 46 that is being nailed by the nailing device 10 as it is moving. As shown in FIG. 1, the drive wheels 14 are canted in such a direction that when the nailing device 10 is moved to the right, as viewed in FIG. 1, the drive wheels 14 draw or pull the device 10 into the end floorboard 46 that is being secured by the device 10. This is also readily seen in FIG. 4. FIG. 4 shows the end view of the nailing device 10 having the drive wheels 14 canted such that as the nailing device is moved in the direction into the plane of the paper, the drive wheels 14 drive the nailing device 10 into the end floorboard 46 that is being secured.

As stated above, the lever handle 40 can be pivoted in the opposite direction to pivot the drive wheels 14 in the opposite direction. In this manner, the nailing device 10 can be used to nail the end floorboard 46 in either direction. That is, the nailing device 10 becomes bi-directional. For example, the drive wheels 14 are placed in the position as shown in FIG. 1 by moving the lever handle 40. The nailing device 10 is then moved in one direction, i.e., to the right as viewed in FIG. 1. In this manner, the drive wheels 14 draw the nailing device 10 into the end floorboard 46 being secured. When the nailing device 10 has reached the end of the row of floorboards 46 to be nailed, the lever 40 is pivoted in the opposite direction, moving the first and second 30, 32 tie rods and thereby pivoting the axle brackets 26 and thereby drive wheels 14 in the opposite direction. The nailing device 10 can then be moved in the direction to the left as viewed in FIG. 1 and the drive wheels 14 will continue to draw the nailing device 10 into the last floorboard 46 being secured to the floor by the nailing device 10.

The nailing device 10 can be driven in one of two manners. Specifically, the nailing device 10 can be automatically driven by a motor generally indicated at 48. Alternatively, the nailing device can be driven manually by the use of a handle 50.

As shown, the motor 48 comprises an electric motor 52 connected to at least one of the drive wheels 14. The motor 52 is also supported by a mounting flange 54 moveably mounted to base 24. Thus, as the drive wheels 14 pivot, as set forth above, the electric motor 52 also pivots. Preferably, the electric motor 52 is coupled with the shaft of the drive wheel 14 to rotate the shaft and thereby the drive wheel 14 when the electric motor 52 is energized. The electric motor 52 is preferably bidirectional. That is, the motor 52 can operate to drive the drive wheels 14 in either a clockwise or counterclockwise direction to determine the direction of travel of the nailing device 10. Preferably, electric motor 52 is a DC motor that receives it power from onboard batteries. It will be appreciated, however, that the electric motor 52 could also be an AC motor.

Further, while an electric motor 52 is preferred, it will be appreciated that any suitable drive motor may be used as the motor 48. While the drive motor 48 is shown as connected to one drive wheel 14, it will be appreciated, as shown in FIG. 6, that the drive motor 48 may be connected to the opposite drive wheel 14. Further, while only one drive motor 48 is shown, it will be appreciated that a drive motor 48 may be connected to each of the drive wheels 14. The drive motor 48 is also coupled with an onboard central processing unit (PLC) schematically shown at 56.

The PLC 56 is disposed in the PLC housing 18. The PLC housing 18 preferably comprises an enclosure having four sidewalls 19, a top 21, and a bottom 23. The top 21 is preferably removable to provide access to the enclosure.

A switch 58, disposed on the top 21, is used to control energization of the motor 48. Specifically, the switch 58 can be turned to an on position to open a circuit between the batteries schematically shown at 60 and the motor 48. The actual signal used to control the driving of the wheels 14, however, is generated by the PLC 56, as will be described further below.

The batteries 60 can comprise any suitable battery. For example, when the operation is automatic and the motor 48 is used, the batteries 60 can comprise two 12 volt lead acid batteries. It is also preferred that a quick-change feature is incorporated so the batteries 60 can be quickly changed. Thus, the circuitry for the PLC 56 and motor 48 is powered on 24 volts.

If only a manual version is used, and no motor 48 is used, the batteries 60 may comprise lower voltage motorcycle batteries. This is because the only energy required is that to drive the PLC 56.

The batteries 60 are contained in battery housing 20 supported on the carriage assembly 12. The housing 20 is preferably closed to prevent debris from contacting the batteries 60. The housing 20 can be opened to access the batteries. Further, the housing 20 has openings to allow power lines to extend between the batteries 60 and the PLC 56, and the batteries 60 and the drive motor 48.

In the event manual operation of the nailing device 10 is desired, manual actuation can be achieved by using the handle 50. As shown in FIG. 1, pushing on the handle 50 causes movement of the nailing device 10 to the right. Preferably, the handle 50 is mounted to the top 21 of the PLC housing 18 at a point in between the drive wheels 14. It is most preferred that the handle 50 be centrally located between the drive wheels 14. The handle 50 is pivotal and can be locked in various positions with respect to the top 21 of the PLC housing 18. Specifically, as shown in FIG. 1, a locking mechanism, generally indicated at 62, is connected to the handle 50. A series of detents, schematically illustrated at 64, are provided at locations in which the handle 50 can be locked. A release button 66 is provided. Depression of the release button 66 allows the handle 50 to be moved from one detent 64 to another detent 64. In this manner, the handle 50 can be pivoted to a suitable orientation with respect to the PLC housing 18 for operation. It is most preferred that the handle 50 be pivotal through 360° of rotation. It will, however, be appreciated that the handle 50 may only be pivotal between 180° of rotation. Any number of locking detents 64 may be used.

As shown in FIG. 1, the handle 50 can be used to push the nailing device 10 to the right as viewed in FIG. 1. Alternatively, the handle 50 can be used to pull the nailing device 10 in the opposite direction. The drive wheels 14 are preferably pivoted to always be oriented in such a manner as to draw the nailing device 10 into the floorboard 46 being secured. Alternatively, in order to reverse direction of the nailing device 10, the handle 50 can be pivoted by depressing the release button 66 and rotating the handle to a position 180° opposed to that shown in FIG. 1. The release button 66 is then released allowing the handle 50 to lock in a suitable detent 64. In this manner, the nailing device 10 can be pushed by handle 50 in the direction opposite to that shown in FIG. 1 to run the nailing device 10 in the opposite direction.

As set forth above, a nailer assembly 16 is connected to the carriage assembly 12. The nailer assembly 16, is used to fire nails or staples into the floorboard 46 being secured at an appropriate angle. Typically, the nailer assembly 16 is disposed at an angle so as to drive a nail or staple at point above a tongue in the floorboard 46 through the bottom and into the suitable support structure, in a well known manner. Such nailers are well known in the art. The nailer assembly 16 is supported by a suitable support structure generally indicated at 68. The support structure 68 is secured to the base 24. The support structure 68 preferably can accommodate different commercially available nailer assemblies 16. That is, the nailer assemblies 16, from different manufacturers, have different configurations. In order to accommodate different nailer assemblies 16, the support structure 68 can be sized or configured to receive any such nailer assembly 16.

Generally, the nailer assembly 16 includes a housing 70. The nailer assembly 16 further includes a fastener receptacle or magazine 72. The fastener receptacle or magazine 72 is adapted to receive nails or staples, depending on which fastener is used to secure the floorboards 46 to the support structure 68. The fastener receptacle 72 can be that which is provided with the commercially available nailer assembly 16. Alternatively, the fastener receptacle 72 can be modified so as to provide a suitable number of fasteners to the nailer assembly 16. For example, the fastener receptacle 72 may be lengthened to increase more fasteners. This is particularly desirable when using an automated nailer due to the increased speed of such a device.

The nailer assembly 16 comprises a nailer base generally indicated at 73. The nailer base 73 includes a shoe 74 and ledge 75, best seen in FIG. 5. The shoe 74 preferably comprises a polymeric pad, as is well known in the art. The shoe 74 rests upon the floorboard 44 that has been secured in a conventional manner. The base 73 also includes a ledge 75 as is well known in the art. The ledge 75 provides a surface for engaging the top outer edge of the floorboard 46 to be secured above the tongue to align the nailer assembly 16 in the proper orientation relative to the floorboard 46 being secured. It will be appreciated that only that portion of the shoe 74 that rests on top of the floor 44 that has already been secured is preferred to be polymeric. The ledge 75 may or may not be of a polymeric material.

Figure 10:
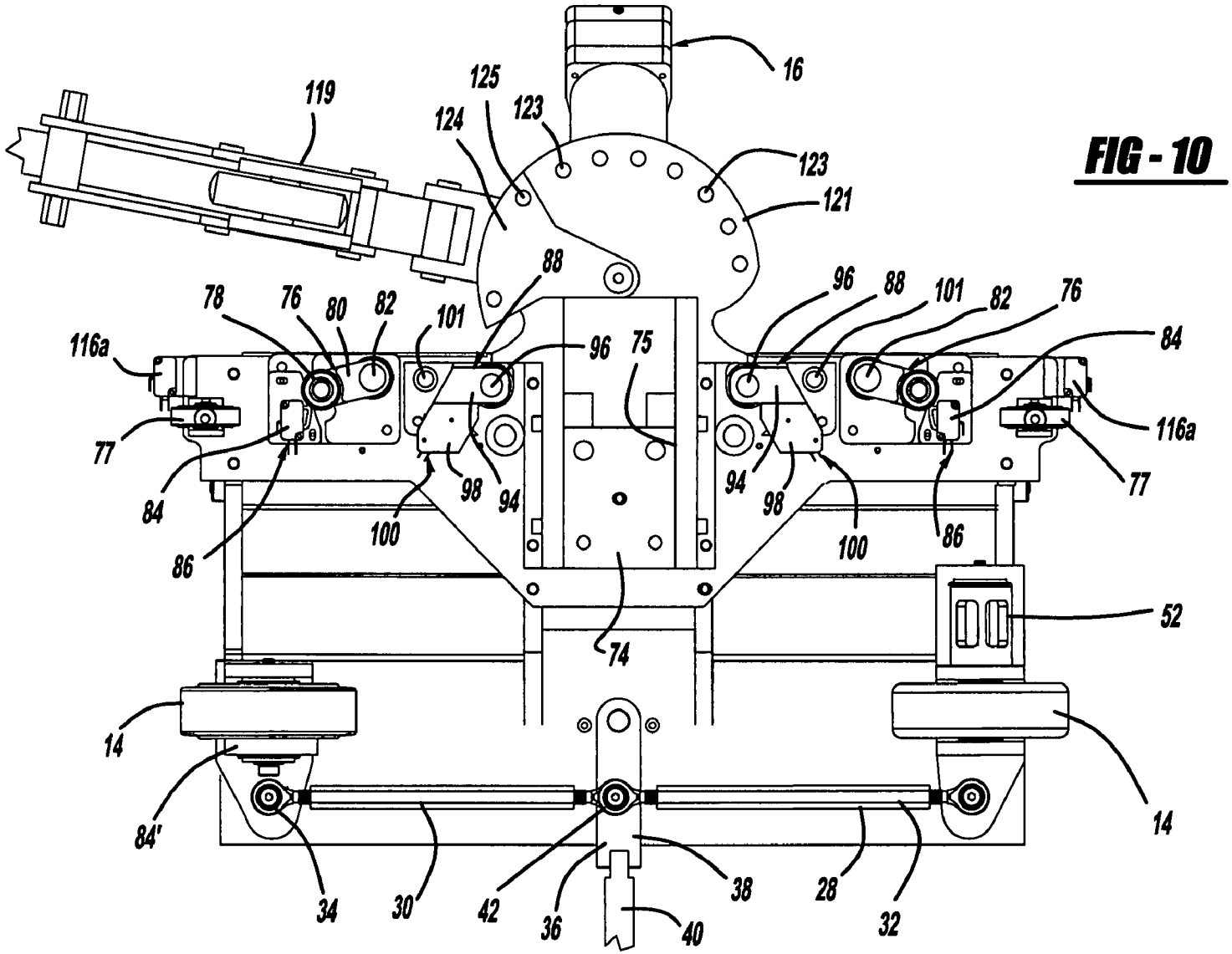
FIG. 10 is a bottom perspective view of the alternate embodiment of FIG. 9.

In an alternate embodiment shown in FIG. 10, at least one adjustable wheel 77 is connected to the carriage assembly 12. Preferably, adjustable wheels 77 are connected to the base 24 and rotate to allow movement of the nailer device 10 in any direction. More preferably, there are two adjustable wheels 77 connected to the base 24, one on each end of the carriage assembly 12. The adjustable wheels 77 are adjusted to alter the height of the nailer device 10 in order to alter the nailer device 10 to be used on different sized flooring and to create a gap between the shoe 74 and the floorboard 44. Typically, the floorboards 44 come in different heights, such as but not limited to, floorboards 44 having a height of ¼inch or ½inch. Thus, the adjustable wheels 77 can be altered in height in order to place nailer assembly 16 at the desired point with respect to the floorboard 44 to be secured. More specifically, the adjustable wheels 77 are used to resize the shoe 77 so that it is disposed slightly over the top of the floorboard being laid, thus creating a very small gap therebetween.

By forming the gap, the shoe 74 preferably does not contact the floorboard 44 and friction between the shoe 74 and floorboard 44 is diminished which can otherwise cause the nailer device 10 to pivot and become misaligned with respect to the floorboard 46 to be secured. Preferably, the gap is very small so that the alignment of the nailer assembly 16 with respect to the floorboard 46 to be secured is not altered to the point where it affects the firing of the nail or staple by the nailer assembly 16 into the floorboard 46 to be secured. Thus, the ledge 75 still engages the top outer edge of the floorboard 46 to be secured above the tongue to align the nailer assembly 16. Further, since the adjustable wheels 77 are adjustable, the height can be varied in order to accommodate different floor or subfloor surfaces in which the nailer device 10 is being used on, but the adjustable wheels 77 do not raise the nailer device 10 to a height where the drive wheels 14 become inoperable.

In reference to FIGS. 1-10, in the preferred embodiment, the nailer assembly 16 is pneumatically actuated in a conventional manner. The nailer assembly 16 is connected to an air source, such as a compressor (not shown) via a hose (not shown). Firing of a nail or staple by the nailer assembly 16 is accomplished by a signal sent from the PLC 56 that is coupled with the nailer assembly 16 in any suitable manner. That is, the PLC 56 sends a suitable signal to the actuator when activation is desired to fire a fastener. While the nailer assembly 16 is preferably pneumatically activated, it will be appreciated that any actuation arrangement may be used within the scope of the present invention.

Figure 7:
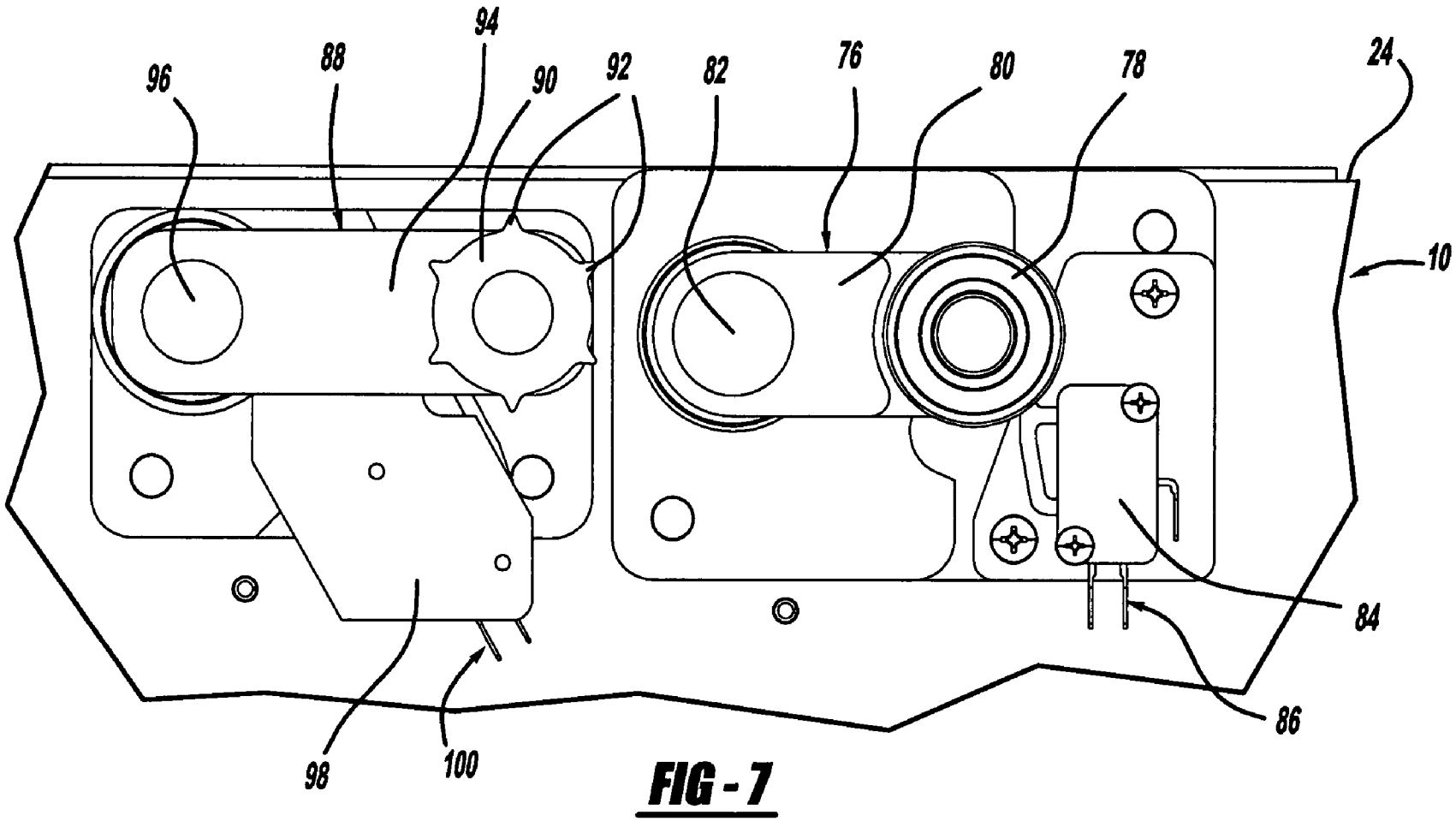
FIG. 7 is a sectional view taken along arcuate line 7-7 of FIG. 6.

The base 24 includes at least one and preferably a pair of guide assemblies, generally indicated at 76 as best shown in FIGS. 6 and 7. Each guide assembly 76 includes a guide wheel 78 rotatably secured to a mounting bracket 80. The mounting bracket 80 may be pivotally or fixably secured to the base 24 at mounting point 82. In the most preferred embodiment, the guide wheel 78 is rotatably secured to mounting bracket 80 that is pivotally secured to mounting point 82. However, there is a limit to which a mounting bracket 80 may be pivoted about mounting point 82. Specifically, it is preferred that the guide wheel 78 not be pivotal beyond a predetermined amount outwardly of the base 24, as viewed in FIG. 7. Most preferably, each guide wheel 78 is in the position parallel to the direction of the travel of nailing device 10 as shown in FIG. 7.

Each guide wheel 78 engages the top portion of the floorboard 46 that is being secured above the tongue on the outer edge. The guide wheels 78 align the nailing device 10 and prevent the nailing device 10 from being pulled into the floor 44 in the direction of the biasing of the guide wheels 14. Thus, the guide wheels 78 maintain the orientation of the nailing device 10 with respect to the floorboard 46 being secured.

Guide wheel 78 is also secured to a suitable sensor 84. The sensor 84 is coupled with PLC 56 preferably through wires, generally indicated at 86. The purpose for coupling the guide wheel 78 with the PLC 56 is to provide a signal regarding the length of travel of the nailing device 10 to determine when to fire a fastener from the nailer assembly 16, as will be set forth in further detail below. The sensor 84 monitors or measures the distance that the nailing device 10 has traveled as the guide wheel 78 rotates. The sensor 84 sends a signal via wires 86 to the PLC 56 indicating the distance traveled. The sensor 84 can be either mechanically connected to the guide wheel 78 to measure the movement of the guide wheel 78, or the sensor 84 can be an angular optical sensor for monitoring the angular rotation of the guide wheel 78.

Figure 2:
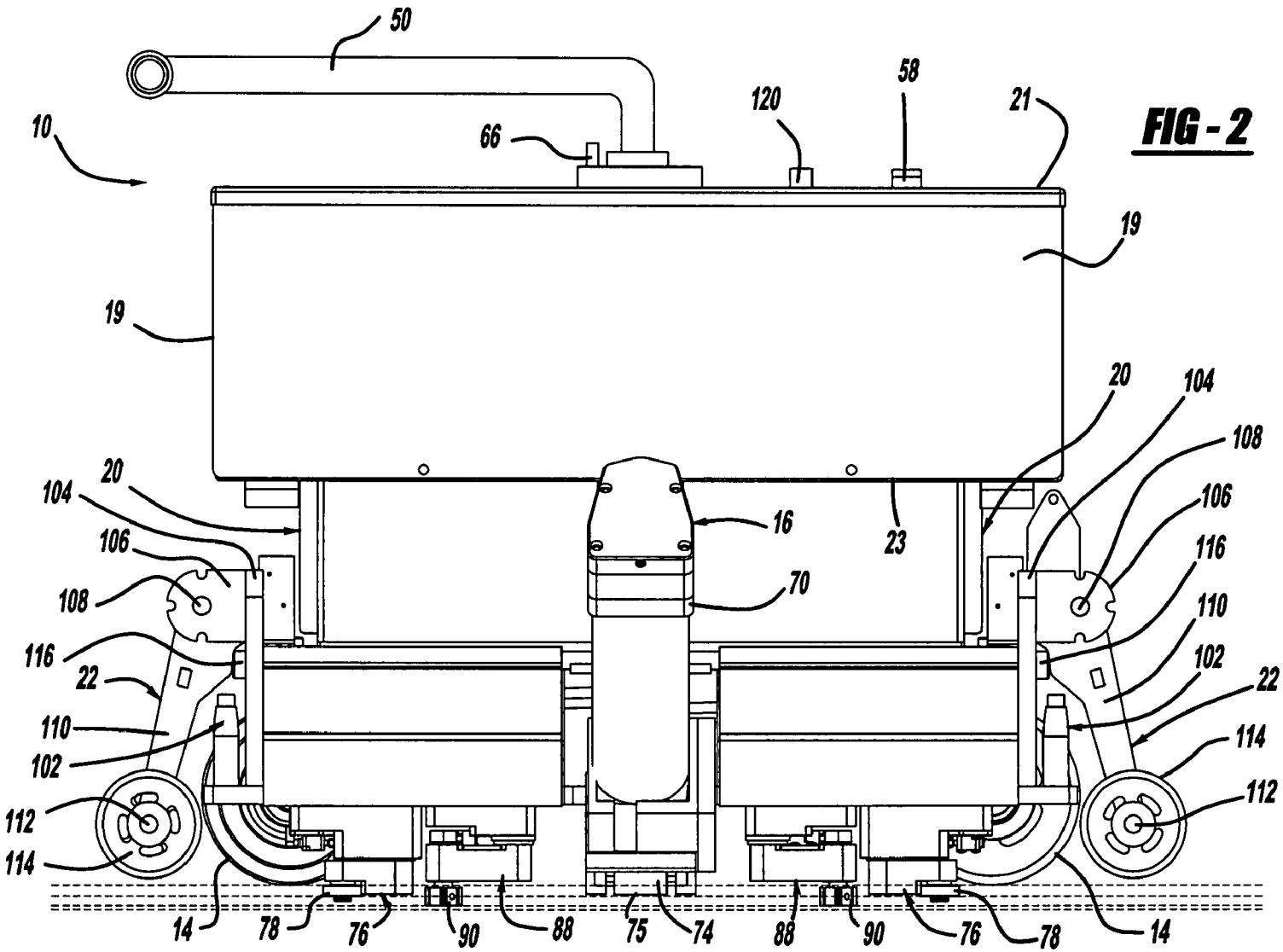
FIG. 2 is a side view of the embodiment of FIG. 1.

The sensor for monitoring the distance that the nailing device 10 has traveled may also be associated with the drive wheel 14. As is shown in FIG. 10, a suitable sensor 84' may be associated with the drive wheel 14 to determine its displacement. This will measure movement of the drive wheel 14 and provide that information to the PLC 56.

shown in FIG. 6, two sets of guide assemblies 76 are used. Since the nailing device 10 can be used in either direction, it is preferred that two sets of guide assemblies 76 are utilized. Both of the guide wheels 78 help aligned the nailing device 10 in the proper orientation as it is moved along the floorboard 46 being secured. However, it is only necessary that one of the guide assembly 76 at a time is actually used to send a signal to the PLC 56 as set forth above. Preferably, however, only one guide assembly 76 is used at any time to send a signal to the PLC 56. Most preferably, the active guide assembly 76 that is forward of the nailer assembly 16 in the direction of movement of the nailing device 10 is used to generate and send the signal to the PLC 56. Thus, as shown in FIG. 2, when the nailing assembly 16 is moved to the right, the sensor 84 on the guide assembly 76 to the right of the nailer assembly 16 is used to send the signal to the PLC 56. When the device is moved in the opposite direction, i.e., to the left as viewed in FIG. 2, the guide assembly 76 to the left of the nailer assembly 16 is used to send the signal to the PLC 56. The manner in which the correct sensor 84 is selected can be accomplished by coupling the activation of the sensor 84 to the position of the lever handle 40. Alternatively, it can be accomplished by detecting the position of the handle 50. Also, the PLC 56 can send a signal to activate the appropriate sensor 84 depending on the direction of travel of the nailing device 10. It will be appreciated, however, that any other suitable manner for selecting which guide assembly 76 is used to send the signal to the PLC 56 may be used within the scope of the present invention.

Figure 3:
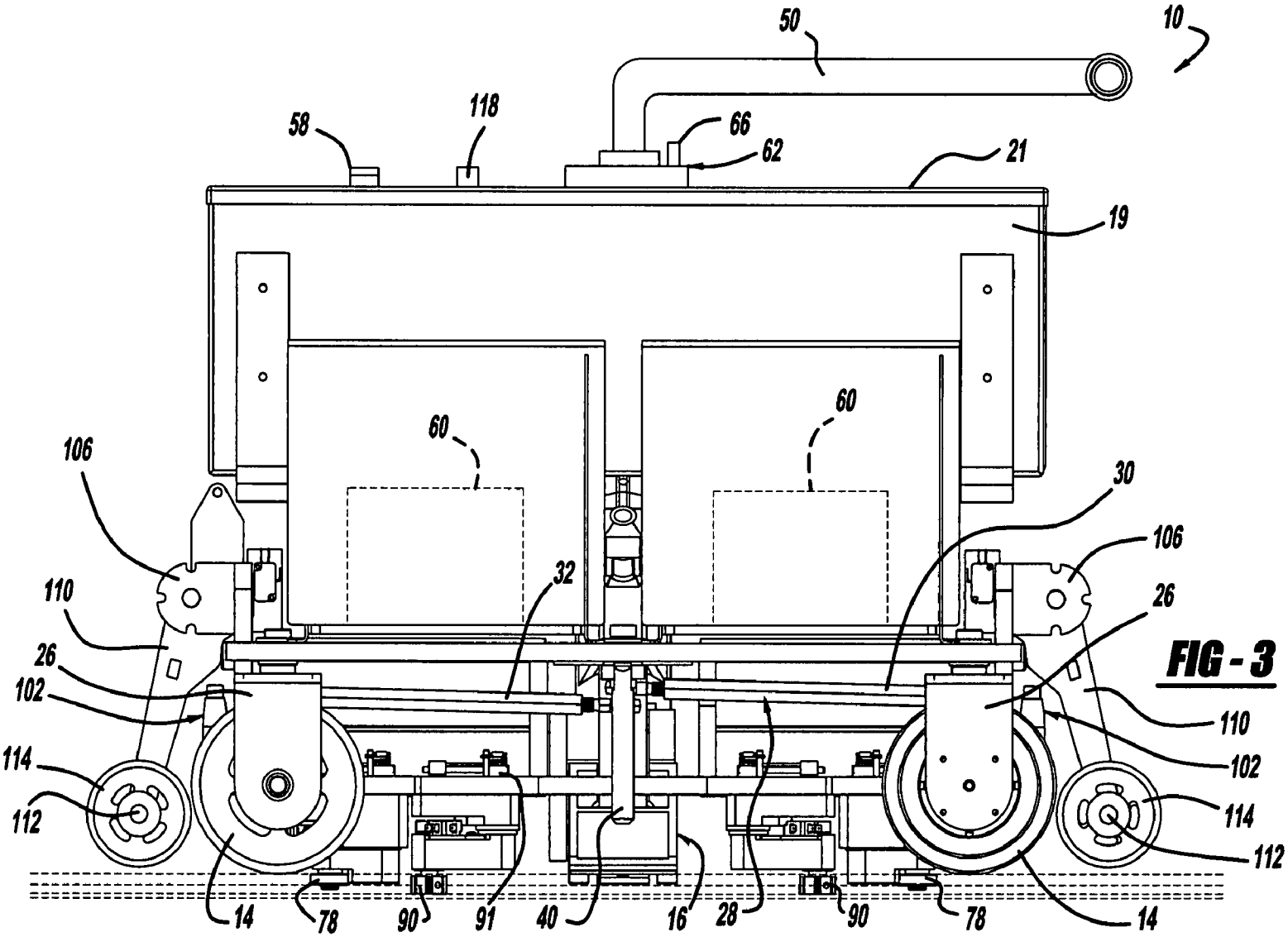
FIG. 3 is a side view of the embodiment of FIG. 1.

The nailing device 10 further includes an end edge detection assembly, generally indicated at 88 secured to the base 24. Most preferably, a pair of end edge detection assemblies 88 are used. The end edge detection assemblies 88 are best shown in FIGS. 6 and 7. The end edge detection assemblies 88 include a rotating wheel 90 having a plurality of projections 92 thereon. The rotating wheel 90 is rotatably mounted on mounting bracket 94. The mounting bracket 94 is pivotally secured about mounting point 96. In the most preferred embodiment, the rotating wheel 90 is biased in the direction of the floorboard 46 being secured during operation of the nailing device 10 by a suitable biasing mechanism, e.g., a spring 91 as shown in FIG. 3.

The rotating wheel 90 rotates when the projections 92 engage the end edge 47 of the tongue of the floorboard 46 being secured. Specifically, it is common that the tongue of the tongue-and-groove flooring 44 are slightly spaced inwardly from the end edges of the individual floorboards 44. Thus, there is slight gap between the tongues of adjacent floorboards 46 along the same row. The projections 92 engage this gap because of the biasing of the rotating wheel 90 in the direction of the floorboards 46 being secured. That is, the spring 91 biases the projections 92 into the end edge 47 gap. As the nailing device 10 moves further, the movement is translated to the rotating wheel 90 and the wheel 90 rotates. This is a result of the force applied to the projections 92 as it engages the end edge 47 gap in the tongues between adjacent floorboards 46 being secured. This movement is detected by a sensor 98. The sensor 98 transmits a signal, via wires, generally indicated at 100 to the PLC 56. In this manner, rotation of the wheel 92 generates a signal in the sensor 98 which is sent to the PLC 56 to indicate that the edge of a floorboard 46 being secured has been detected. The PLC 56 can then send a signal to fire the nailer assembly 16 at a suitable location, as will be described in more detail below.

In reference to FIG. 10, in an alternate embodiment, the end edge detection assembly 88 has at least one sensor. Preferably, the sensor 101 is an optical sensor that is capable of detecting the end edge 47 gap between tongues of adjacent floorboards 46 being secured. It will be appreciated, however, that the sensor 101 can be any other tactile sensor. Thus, the sensor 101 is similar to the rotating wheel 90 described above in that when the sensor 101 detects the end edge 47 gap between the tongues of adjacent floorboards 46 being secured, the sensor 101 transmits a signal, via wires, to the PLC 56. Then the PLC 56 can send a signal to fire the nailer assembly 16 at a suitable location, as described in greater detail below.

As best viewed in FIGS. 1, 2, and 4, the nailing device 10 includes a board sensor generally indicated at 102. Most preferably, a pair of board sensors 102 are included. The board sensor 102 detects whether a floorboard 46 to be secured is in position to be nailed. The board sensor 102 is mounted to the base 24 of carriage assembly 12. Preferably, the board sensor 102 is mounted outwardly of upstanding walls 104

In the preferred embodiment, the board sensor 102 comprises an optical sensor that is coupled with the PLC 56. The board sensor 102 that is on the forward edge of the nailing device 10 in the direction of travel of the nailing device 10 is used to determine whether a floorboard 46 to be secured is in position to be nailed to the support structure. That is, the board sensor 102 scans the floor. If a floorboard 46 to be secured is detected, operation of the nailing device 10 is normal. However, if the board sensor 102 detects that a floorboard 46 to be secured is not present, it sends a signal to the PLC 56 to cease operation of the nailing device 10. Again, two board sensors 102 are preferred so that the nailing device 10 can be used in either direction. The board sensor 102 that is on the forwarded edge of the unit, in the direction of travel of the nailing device 10, is the active board sensor 102. Switching between these board sensors 102 to determine which is active can be made in any suitable manner and preferably is determined by the PLC 56.

The carriage assembly 12 includes a pair of end wheel assemblies 22. The end wheel assemblies 22 are pivotally secured to a pair of the upstanding walls 104 connected to the base 24. The upstanding walls 104 are located in the end region of the base 24. As best shown in FIGS. 1-3, a pair of mounting flanges 106 are fixed in space orientation on the upstanding walls 104. The mounting flanges 106 pivotally support a rod 108 thereon. The rod 108 is secured to a pair of spaced support arms 110. An axle 112 is disposed at the lower end of support arms 110 and rotatably supports a pair of end wheels 114. It is preferred that the end wheels 114 are supported at a position above the floorboards 44 during normal operation as best shown in FIG. 3.

The end wheel assemblies 22 provide two main functions. The end wheel assemblies 22 are used to detect when the nailing device 10 has reached the end of the run such as by contacting a wall at the end of the floorboards 44 or some other structure. Additionally, the end wheel assemblies 22 are used to move the nailing device 10 from one row of floorboards 44 that have been nailed to the next adjacent row of floorboards 46 to be secured.

As best seen in FIG. 5, support arms 110 include a sensor 116 thereon. The sensor 116 is coupled with the PLC 56 for transmitting a signal to the PLC 56 when the nailing device 10 has reached the end of a row. The sensor 116 may comprise a limit switch that is activated when the end wheels 114 engage a structure.

The support arms 110 pivot on the rod 108 in response to the end wheels 114 contacting a support structure such as a wall. The sensor or limit switch 116 is situated on the support arm 110 in such a manner that as the support arms 110 pivot toward the upstanding wall 104 (in response, for example, to the wheels 114 contacting a wall at the end of the row of floorboards 46 to be secured), the sensor 116 engages the upstanding wall 104 and sends a signal to the PLC 56 indicating that the carriage assembly 12 has reached the end of a row. In order to move the nailing device 10 to the next adjacent row, the nailing device 10 is pivoted on to the end wheels 114 by tilting the nailing device 10 through the use of the handle 50. The nailing device 10 can then be manipulated on its end wheels 114 to the next adjacent row of floorboards 46 to be secured.

Figure 9:
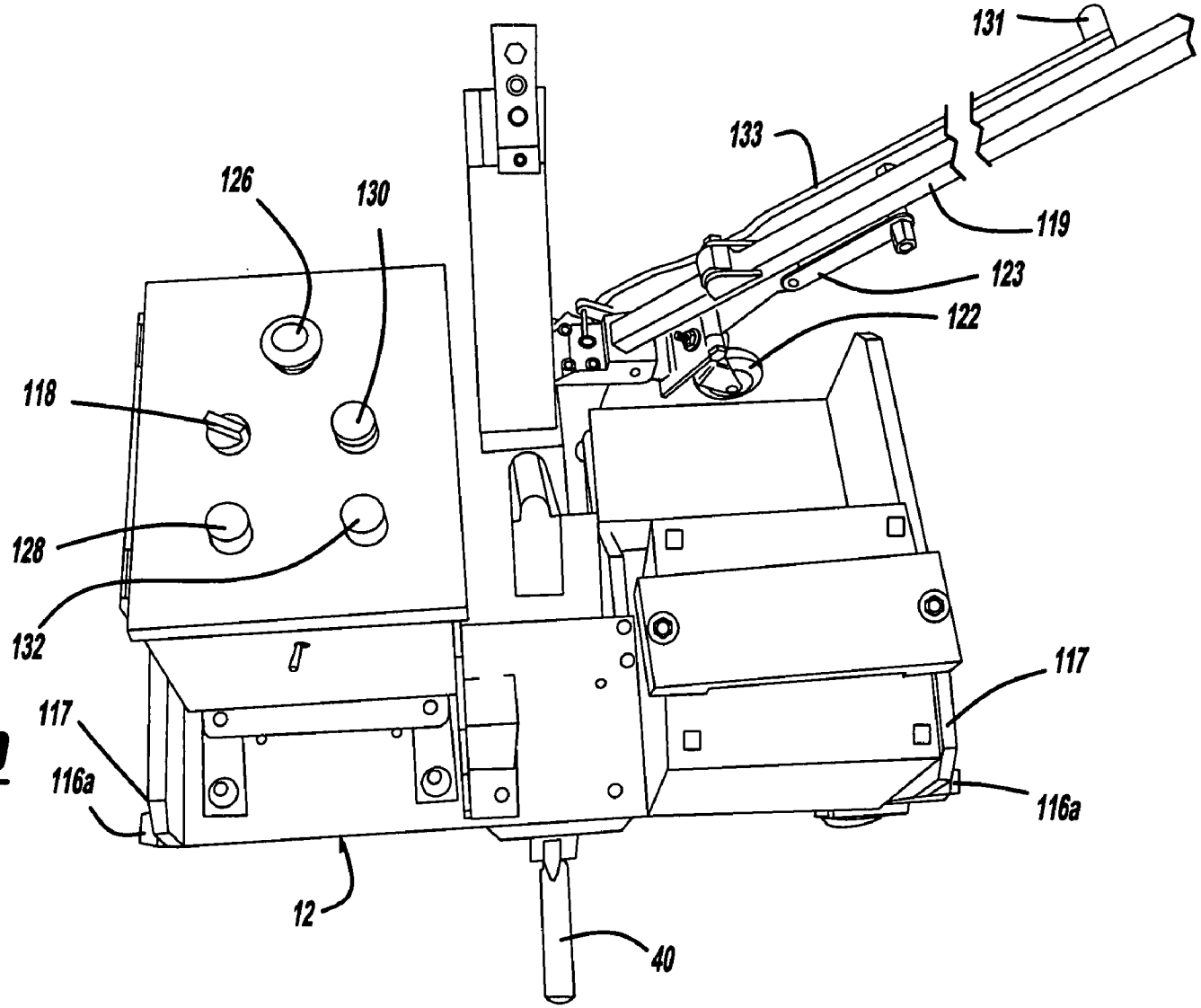
FIG. 9 is a top perspective view of an alternate embodiment.

In an alternate embodiment shown in FIG. 9, the end wheel assemblies 22 are removed and a flange 117 extends from both ends of the carriage assembly 12. Like numerals are used to represent like components thought the various embodiments. The sensor or limit switch 116*a* is placed on the end of the flange 117 that extends beyond any other portion of the carriage assembly 12, such that a sensor or limit switch 116*a* will contact a surface and signal to the PLC 56 that the nailing device 10 has reached the end of the row.

In the alternate embodiment, since the end wheel assemblies 22 are removed, a handle 119 is disposed from a midpoint (that is, spaced inwardly from the ends) of the carriage assembly 12 by a semicircular flange 121 on the chassis. The handle 119 pivots about the flange 121 so that a wheel 122, which is preferably outside the width of the carriage assembly 12, can engage or disengage the floorboard 44, 46 or subfloor. In the most preferred mode, the wheel 122 can be manually received or lowered from the floor. A suitable linkage assembly 123 connects the structure to allow the wheel 122 to be raised or lowered. Further, the semicircular flange 121 has a plurality of openings 123 so that the angle that the handle 119 extends from the carriage assembly 12 can be altered. Thus, a pin (not shown) extends through a handle plate 124 that has openings 125 that align with openings 123 to secure the orientation of the handle 119. The pin 131 is operable via a lever on the handle connected with a linkage assembly 133. Thus, when the nailer device 10 reaches the end of a row or is being moved at a time when the nailing device 10 is not firing staples or nails, the wheel 122 can be engaged to move the nailing device 10 either to a new row of floorboards 46 to be secured or another location. It will be appreciated that the handle 119 can also be used to manually operate the assembly.

The PLC 56 can be programmed to receive the distance a row of floorboards 46 to be secured extends. Thus, the sensor 84 monitors the rotational distance of the drive wheels 14 and sends a signal to the PLC 56 so that the PLC 56 can determine when the nailing device 10 has traveled the commanded distance at which point the PLC 56 commands the motor 48 to stop rotating the drive wheels 14. Therefore, the sensor 116 or limit switch 116*a* is not needed.

The nailing device 10 also may include a pair of dials 118, 120. A fastener setting dial 118 is provided to set the default spacing between the fasteners. That is, the fastener setting dial 118 may have a plurality of positions representing the spacing between adjacent fasteners to be fired by the nailer assembly 16. For example, but in no way limiting, the dial 118 may include spacing of 8, 9, 10, and 12 inches. The dial 118 can be set to any of these positions so that the default firing of the nailer assembly 16 will be the number of inches set at the fastener setting dial 118. As set forth above, the distance between the adjacent fasteners is measured by the guide wheel 78. Thus, the fastener setting dial 118 is coupled with the PLC 56 to set the linear distance between the firing of adjacent fasteners. The fastener setting dial 118 can be used in either of the manual or automatic modes.

A speed setting dial 120 is also provided. The speed setting dial is used when the unit is automatically driven by the electric motor 52. The speed setting dial includes settings for the number of feet per minute, or the like, to be moved by the nailing device 10. The speed setting dial 120 is coupled with the PLC 56. The PLC 56 is coupled with the electric motor 52 and sets the speed of the electric motor 52 to that set on the speed setting dial 120. Further, an emergency stop button 126, a start button 128, a stop button 130, an indicator light 132 indicating operation, or the like, can be provided on the nailer device 10 for use during operation.

Figure 8:
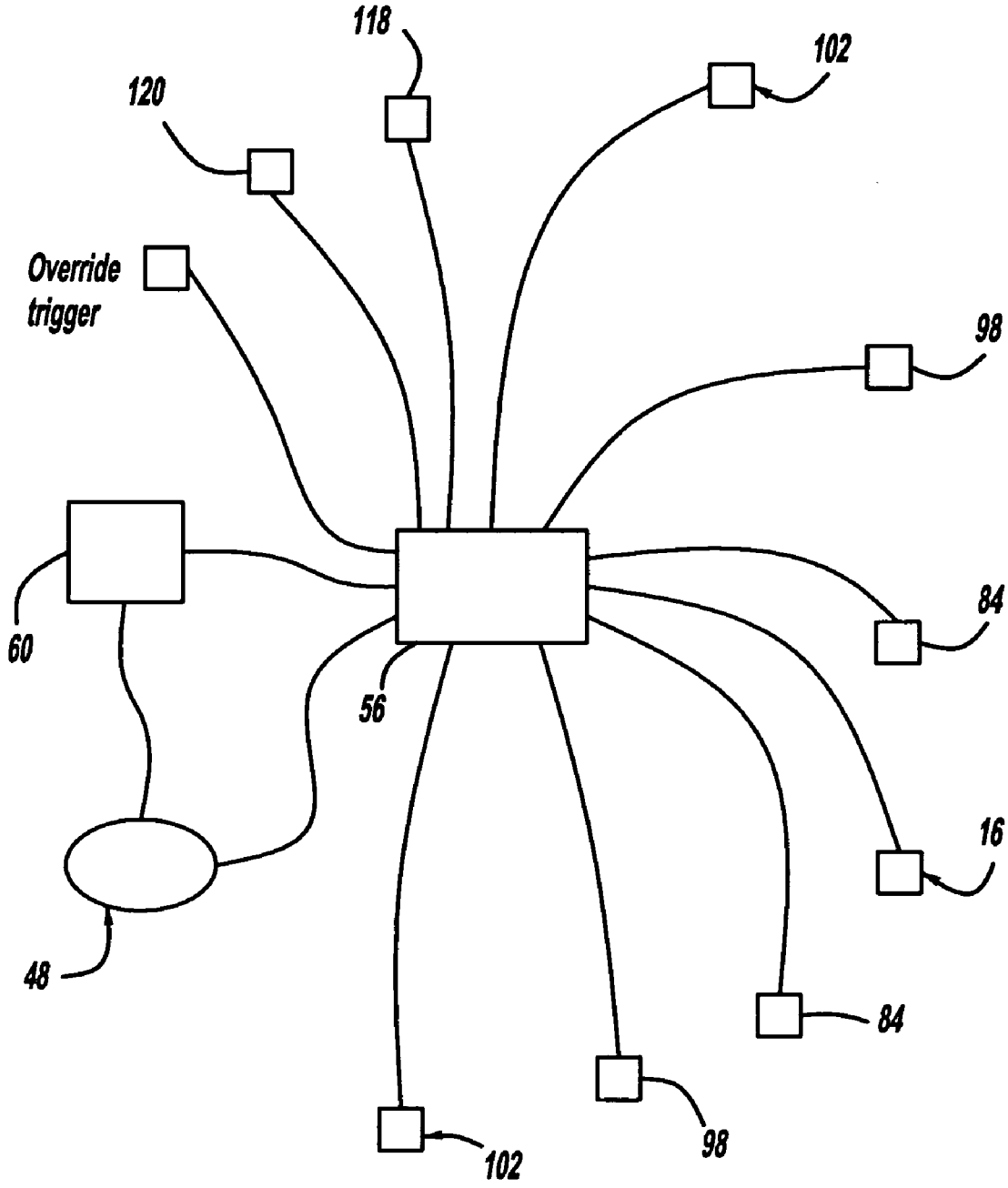
FIG. 8 is a schematic view of the power and sensor circuits.

FIG. 8 is a schematic view showing the power and sensor circuits. The power circuit schematically shows the batteries 60 providing power via a line to the PLC 56. Power is also provided via a line from the batteries 60 to the drive motor 48.

The PLC 56 circuits are also schematically shown in FIG. 8. The PLC 56 is coupled with the fastener setting dial 118 via an appropriate electrical connection. The speed setting dial 120 is coupled with the PLC 56 via an appropriate electrical connection. An override trigger which can be either remote or on the handle 50, 119 is also coupled with the PLC 56 via an appropriate electrical connection. Similarly, the sensors 84, 92, 102 are each coupled with the PLC 56 via an appropriate electrical connection. Each of the aforementioned sensors 84, 92, 102, dials 118, 120, other controls 126, 128, 130, 132, and triggers provide an input to the PLC 56. The PLC 56 has two outputs. The first output is coupled with the nailer assembly 16. The second output is coupled with the drive motor 48.

In this manner, the PLC 56 receives appropriate sensor inputs and sends outputs to either drive the motor 48 or fire a fastener from the nailer assembly 16.

Operation of both modes, automatic and manual, will now be described with reference to FIGS. 1-10. With respect to the automatic operation of the nailing device 10, a row of floorboards 46 to be secured is first racked into place by an operator. The adjustable wheels 77 may be provided to provide a gap between the shoe and the floorboard. The nailing device 10 is then positioned at the end of the row of the floorboards 46 to be secured, in this example, to the leftmost edge as viewed in FIG. 1. An air supply line (not shown) is connected to the nailer assembly 16. The lever 40 is rotated until the drive wheels 14 are positioned in the manner shown in FIG. 1. As the nailing device 10 is positioned, it is supported on the top of the floor 44 by any of the two drive wheels 14, the shoe 74, the end wheel assemblies 22, the adjustable wheels 77, or a combination thereof. The nailing device 10 is positioned such that the guide wheel 78 engages the floorboard 46 to be secured at a location above the tongue. This is best seen in FIGS. 1 and 3.

Also, the rotating wheel 90 engages the floorboard 46 to be secured. Alternatively, the sensor 101 is used to monitor or sense the gap between tongues of adjacent floorboards 46 to be secured, and the rotating wheel 90 is removed. The default spacing between firing of fasteners is set on the fastener setting dial 118 (for example, the fastener setting dial is set to 10 inches) and the speed of movement of the nailing device 10 is set on the speed setting dial 120.

Once the nailing device 10 is positioned, and the settings are made, the switch 50 is energized and the PLC 56 sends a signal to the electric motor 52 to begin operation. The electric motor 52 drives drive wheels 14 and moves the nailing device 10 to the right as viewed in FIG. 1. After the nailing device 10 passes along the desired distance, as measured by the guide wheel 78 and sensor 84, and provided it has not detected and end edge 47 of a floorboard 46 to be secured, the sensor 84 sends a signal to the PLC 56 which, in turn, sends a signal to the nailer assembly 16 to fire a fastener. The PLC 56 then resets and the guide wheel 78 and sensor 84 begin measuring the next predetermined spacing, e.g., 10 inches, to fire the next fastener. This process is repeated until the rotating wheel 90 or sensor 101 detects the end edge 47 of a floorboard 46 to be secured. When the rotating wheel 90 is being used and the projection 92 engages the tongue at the end edge 47 of a floorboard 46 to be secured, the rotating wheel 90 pivots with mounting bracket 94 and sends a signal to the PLC 56 that the nailing device 10 has reached the end edge 47 of a floorboard 46 to be secured. Similarly, the sensor 101 detects the end edge 47 of the floorboard 46 to be secured and the sensor 101 transmits a signal to the PLC 56.

The PLC 56 analyzes the location of the end edge 47, because the spacing between the nailer assembly 16 and the rotating wheel 90 is known. The PLC 56 sends a signal to the nailer assembly 16 to fire a fastener at an appropriately spaced interval from the end edge 47 of the floorboard 46 to be secured, for example, 2 inches. The nailing device 10 then continues to travel down the edge of the floorboard 46 to be secured. The guide wheel 78 measures the distance and the associated sensor 84 sends a signal to the PLC 56 to fire another fastener at an appropriate distance spaced from the end edge 47 of the floorboard 46, to be secured, for example, 2 inches. Thus, when the end edge 47 of a floorboard 46 to be secured is detected by the rotating wheel 90 or sensor 101, the PLC 56 process the information and signals the nailer assembly 16 to fire a fastener at a predetermined location, for example, 2 inches from the end edge 47 of the floorboard 46 to be secured. This signal from the sensor 98 preferably overrides the signal from the guide wheel 78 and associated sensor 84 as it measures the predetermined spacing between fasteners. For example, even if the guide wheel 78 has moved through a distance less than set (e.g., 10 inches) and the rotating wheel 90 and associated sensor 98 or sensor 101 detects the end edge 47 of the floorboard 46 to be secured, the firing of the next fastener is controlled by the signal based on the end edge sensor 98.

It will be appreciated, however, that when the support structure comprises sleepers, the signal from the guide wheel 78 and associated sensor 84 is not overridden or reset. But, the signal for the rotating wheel 90 and associated sensor 98 or sensor 101 will send a signal to fire additional fasteners. This will insure that a fastener will be fired at every sleeper location. The PLC 56 then receives a signal from the sensor 84 associated with the guide wheel 78 or sensor 101 indicating to the PLC 56 that the nailing device 10 has moved 4 inches, i.e., 2 inches past the end edge 47 of the next adjacent floorboard 46 to be secured to fire another fastener. In this manner, floorboards 46 to be secured in the row being fastened have fasteners equally spaced from the end edges 47 of the adjacent floor boards 46 to be secured.

As set forth above, when the end edge 47 has been detected by the sensor 98 associated with the rotating wheel 90 or sensor 101, this overrides and resets the firing at spaced intervals as set on the fastener setting dial 118. That is, after the fastener has been fired at the end edge 47 of the adjacent floorboard 46 to be secured, the PLC 56 resets the spacing and determines when the sensor 84 associated with the guide wheel 78 has determined that the nailing device 10 has moved through the next predetermined spacing (i.e., 10 inches) and fires another fastener.

As the nailing device 10 moves down the row of floorboards 46 to be secured, the board sensor 102 determines that there is, in fact, a floorboard 46 in place to be secured. If the board sensor 102 detects that a floorboard 46 to be secured is not in place, it sends a signal to the PLC 56 to cease operation of the motor 52 and stops operation of the nailing device 10.

Once the nailing device 10 reaches the end of the row, such as at a wall or other structure, the end wheels 114 engage the wall and pivot with support arms 110 until the sensor or limit switch 116 engages the upstanding wall 104. Once the limit switch 116 engages the upstanding wall 104, it sends a signal to the PLC 56 to stop operation of the nailing device 10. Alternatively, the end wheel assemblies 22 are removed and the nailer device 10 has the flanges 117 with limit switches **116*a*. Thus, once the limit switch 116*a* receives the end of a row, such as a wall or other structure, the limit switch 116*a* is activated and sends a signal to the PLC 56 to stop operation of the nailing device 10**.

In order to continue use of the nailing device with the next adjacent row, in one embodiment the operator grasps the handle 50 and pivots the nailing device 10 onto the end wheels 114 and moves the nailing device 10 off the end row. In an alternate embodiment, the operator grasps the handle 119 to engage the wheel 122. The nailer device 10 can then be moved to the next row of floorboards 46 to be secured. The next adjacent row of floorboards 46 to be secured is racked into place. As the nailing device 10 is now at the right hand end of the floor 44, as viewed in FIG. 1, the release button 66 associated with handle 50 is depressed and the handle is rotated 180 degrees until it seats in a detent on the opposite side. Alternatively, the handle 119 angle is altered by removing the pin from the opening 123 and pivoting the handle 119. The lever handle 40 is moved in the opposite direction as initially set to turn the drive wheels 14 in the direction opposite that shown in FIG. 1. The unit is then positioned on the floor 44 in the manner set forth above. The switch 58 is activated and the nailing device 10 operates in the direction to the left as viewed in FIG. 1. The PLC 56 sends a signal to drive the motor 52 in the opposite direction.

Since the sensors 84, 98, 102, 116, **116*a* are located on each respective side of the nailer assembly 16 in the same relative orientation, the nailing device 10 can be used in either direction. Operation in either direction is the same as set forth above. The only difference is which sensors 84, 98, 102, 116, 116*a* are active and the direction of rotation and biasing of the drive wheels 14. The active sensors 84, 98, 102, 116, 116*a* preferably are those forward of the nailer assembly 16 in the direction of travel of the nailing device 10**.

During manual operation, the drive motor 48 is not utilized. Accordingly, the drive motor 48 is not necessary. Movement of the nailing device 10 is effectuated by applying a force to the handle 50, 119 to move the nailing device 10 in the appropriate direction. During manual operation, each of the sensors 84, 98 or sensor 101 for determining the spacing of the fasteners and the detection of the end edges 47 as set forth above may be used. The fastener setting dial 118 may also be utilized. However, the speed setting dial 120 is not necessary. Similarly, the sensors or limit switches 116 on the end wheels 114 or limit switches **116*a* are not necessary as the nailer device 10 unit will be manually stopped by the operator as it reaches the end of the floor 44. Additionally, in this mode, an override trigger (not shown) may be positioned on the handle 50, 119 to permit the operator to fire a fastener at any location. Further, board sensors 102** may be used but are not necessary in the manual mode. Otherwise, operation of the device is the same in the manual mode as it is in the automatic mode.

In either mode, it will be appreciated that the operator may have a remote control that is coupled with the PLC 56. This remote control may include the appropriate fastener setting dial 118 and speed setting dial 120. Additionally, the operator's remote control may include an override trigger for firing the nailer assembly 16 and placing a fastener at any location desired by the operator.

The foregoing description is considered illustrative only of the principles of the invention. The terminology that is used is intended to be in the nature of words of description rather than of limitation. Furthermore, because numerous modifications and changes will readily occur to those skilled in the art, it is not desired to limit the invention to the exact construction and process shown as described above. Accordingly, all suitable modifications and equivalents that may be resorted to fall within the scope of the invention as defined by the claims that follow.

What is claimed is:

1. A nailer device comprising:

a carriage assembly;

a pair of pivotal drive wheels on said carriage assembly;

a nailer assembly;

at least one end wheel disposed adjacent an end of said carriage assembly; and at least one drive motor associated with at least one of said pair of pivotal drive wheels.

2. The nailer device of claim 1 further comprising a handle disposed on said carriage assembly.

3. The nailer device of claim 2, wherein said handle is disposed intermediate of said pivotal drive wheels on said carriage assembly.

4. The nailer device of claim 2, wherein said handle is disposed on a side of said carriage assembly.

5. The nailer device of claim 2, wherein said handle has a locking mechanism, and said handle is pivotal about a flange on said carriage assembly.

6. The nailer device of claim 1 further comprising a lever assembly operably connected to said pair of pivotal drive wheels for altering the angle of said pair of pivotal drive wheels with respect to said carriage assembly.

7. The nailer device of claim 1, wherein said drive motor is a bi-directional electric motor.

8. The nailer device of claim 1 further comprising at least one adjustable wheel connected to said carriage assembly for altering the height of said nailer device.

9. The nailer device of claim 1 further comprising a processing unit interfaced with at least said drive motor.

10. The nailer device of claim 1 further comprising at least one guide assembly disposed on said carriage assembly for controlling the directional movement of said nailer device.

11. The nailer device of claim 10, wherein a first guide assembly and a second guide assembly of said at least one guide assembly are on opposite sides of said nailer assembly, and either said first guide assembly or said second guide assembly is in use depending upon which said guide assembly is in front of said nailer assembly with respect to the direction of movement of said nailer device.

12. The nailer device of claim 10, wherein said at least one guide assembly has at least one guide wheel that contacts a floor to maintain the orientation of said nailer device.

13. The nailer device of claim 12 further comprising at least one sensor interfaced with said guide wheel, wherein said at least one sensor monitors the movement of said guide wheel.

14. The nailer device of claim 1 further comprising an end edge detection assembly disposed on said carriage assembly.

15. The nailer device of claim 14, wherein said end edge detection assembly has a sensor for detecting a gap between a plurality of tongues and a plurality of floorboards that are adjacent to one another.

16. The nailer device of claim 14, wherein said end edge detection assembly has at least one rotating wheel having at least one projection extending radially from said at least one rotating wheel, and said at least one rotating wheel is biased towards a tongue extending from a side of a floorboard.

17. The nailer device of claim 1 further comprising a board sensor disposed on said carriage assembly to detect if a floorboard is in position to be secured.

18. The nailer device of claim 1 further comprising at least one end wheel assembly disposed on at least one end of said carriage assembly.

19. The nailer device of claim 18, wherein said end wheel assembly has at least one end sensor that detects an end of a row of at least one floorboard.

20. The nailer device of claim 1 further comprising at least one flange extending from at least one end of said carriage assembly, wherein at least one limit switch is disposed on said at least one flange, and said at least one limit switch detects an end of a row of at least one floorboard.

21. The nailer device of claim 1 further comprising at least one dial disposed on said carriage assembly for controlling at least one operating characteristic of said nailer device.

22. A nailer device comprising:

a carriage assembly;

a pair of pivotal drive wheels on said carriage assembly;

a nailer assembly;

at least one end wheel disposed adjacent an end of said carriage assembly; and at least one adjustable wheel connected to said carriage assembly to adjust the height of the nailer assembly.

23. The nailer device of claim 22, wherein said adjustable wheel is adjacent said nailer assembly and is adjusted to alter the height of said nailer device.

24. The nailer device of claim 22 further comprising a handle disposed on said carriage assembly.

25. The nailer device of claim 24, wherein said handle is disposed intermediate of said pivotal drive wheels on said carriage assembly.

26. The nailer device of claim 24, wherein said handle is disposed on a side of said carriage assembly.

27. The nailer device of claim 24, wherein said handle has a locking mechanism, and said handle is pivotally about a flange on said carriage assembly.

28. The nailer device of claim 22 further comprising a lever assembly operably connected to said pair of pivotal drive wheels for altering the angle of said pivotal drive wheels with respect to said carriage assembly.

29. The nailer device of claim 22 further comprising at least one drive motor associated with at least one of said pair of pivotal drive wheels.

30. The nailer device of claim 29, wherein said drive motor is a bi-directional electric motor.

31. The nailer device of claim 22 further comprising a processing unit interfaced with at least said drive motor.

32. The nailer device of claim 22 further comprising at least one guide assembly disposed on said carriage assembly for controlling the directional movement of said nailer device.

33. The nailer device of claim 32, wherein a first guide assembly and a second guide assembly of said at least one guide assembly are on opposite sides of said nailer assembly, and either said first guide assembly or said second guide assembly is in use depending upon which said guide assembly is in front of said nailer assembly with respect to the direction of movement of said nailer device.

34. The nailer device of claim 32, wherein said at least one guide assembly has at least one guide wheel that contacts a floor to maintain the orientation of said nailer device.

35. The nailer device of claim 34 further comprising at least one sensor interfaced with said guide wheel, wherein said at least one sensor monitors the movement of said guide wheel.

36. The nailer device of claim 22 further comprising an end edge detection assembly disposed on said carriage assembly.

37. The nailer device of claim 36, wherein said end edge detection assembly has a sensor for detecting a gap between a plurality of tongues of a plurality of floorboards that are adjacent to one another.

38. The nailer device of claim 36, wherein said end edge detection assembly has at least one rotating wheel having at least one projection extending radially from said at least one rotating wheel, and said at least one rotating wheel is biased towards a tongue extending from a side of a floorboard.

39. The nailer device of claim 22 further comprising a board sensor disposed on said carriage assembly to detect if a floorboard is in position to be secured.

40. The nailer device of claim 22, wherein said end wheel assembly has at least one end sensor that detects an end of a row of at least one floorboard.

41. The nailer device of claim 22 further comprising at least one flange extending from at least one end of said carriage assembly, wherein at least one limit switch is disposed on said at least one flange, and said at least one limit switch detects an end of a row of at least one floorboard.

42. The nailer device of claim 22 further comprising at least one dial disposed on said carriage assembly for controlling at least one operating characteristic of said nailer device.

* * * * *